US006599380B2

(12) United States Patent
Zeuner et al.

(10) Patent No.: US 6,599,380 B2
(45) Date of Patent: Jul. 29, 2003

(54) GUANIDINE-THERMITE IGNITER COMPOSITION FOR USE IN GAS GENERATORS

(75) Inventors: Siegfried Zeuner, München (DE); Achim Hofmann, Polling (DE); Roland Schropp, Tegernheim (DE); Karl-Heinz Rödig, Kraiburg (DE)

(73) Assignee: TRW Airbag Systems GmbH & Co. KG, Aschau/Inn (DE)

( * ) Notice: Subject to any disclaimer, the term of this patent is extended or adjusted under 35 U.S.C. 154(b) by 220 days.

(21) Appl. No.: 09/875,526

(22) Filed: Jun. 6, 2001

(65) Prior Publication Data

US 2002/0033211 A1 Mar. 21, 2002

(30) Foreign Application Priority Data

Jun. 7, 2000 (DE) ..... 200 10 154 U

(51) Int. Cl.[7] ..... C06B 33/00
(52) U.S. Cl. ..... 149/37; 149/38
(58) Field of Search ..... 149/36, 37, 38

(56) References Cited

U.S. PATENT DOCUMENTS

| | | | | |
|---|---|---|---|---|
| 4,424,086 A | | 1/1984 | Christopher | |
| 4,963,203 A | | 10/1990 | Halcomb et al. | |
| 5,256,451 A | * | 10/1993 | Philipp et al. | 427/374.2 |
| 5,429,691 A | | 7/1995 | Hinshaw et al. | |
| 5,439,537 A | | 8/1995 | Hinshaw et al. | |
| 5,668,345 A | | 9/1997 | Schroeder et al. | |
| 5,700,974 A | | 12/1997 | Taylor | |
| 5,959,242 A | | 9/1999 | Knowlton et al. | |
| 6,024,811 A | | 2/2000 | Finck et al. | |
| 6,132,537 A | * | 10/2000 | Zeuner et al. | 149/45 |

FOREIGN PATENT DOCUMENTS

| | | | |
|---|---|---|---|
| DE | 2063586 | | 7/1971 |
| DE | 4401214 | | 3/1995 |
| DE | 4435524 | | 4/1996 |
| DE | 19548544 | A1 | 6/1997 |
| DE | 19805976 | C1 | 4/1999 |
| EP | 334725 | A1 * | 9/1989 |
| FR | 2772370 | | 6/1999 |
| GB | 1290418 | | 9/1972 |
| WO | 9504610 | | 2/1995 |
| WO | 9720786 | | 6/1997 |
| WO | 0040523 | | 7/2000 |

OTHER PUBLICATIONS

JP 0010291884 Patent Abstracts of Japan, Pub: Apr. 11, 1998.

* cited by examiner

*Primary Examiner*—John Hardee
(74) *Attorney, Agent, or Firm*—Tarolli, Sundheim, Covell & Tummino L.L.P.

(57) ABSTRACT

The invention relates to an igniter composition for use in a gas generator for a safety means in vehicles. The igniter composition consists of a gas-generating composition in an amount of 15 to 70 wt-% and of a thermite composition in an amount of 30 to 85 wt-%. The gas-generating composition consists essentially of a guanidine compound as fuel and an inorganic oxidizer. The thermite composition consisting essentially of a metal and a metal oxide. The igniter composition or the gas-generating composition and the thermite composition, each for itself, have an oxygen balance of between 0 and −20%.

8 Claims, No Drawings

GUANIDINE-THERMITE IGNITER COMPOSITION FOR USE IN GAS GENERATORS

TECHNICAL FIELD

This invention relates to an igniter composition for use in gas generators for safety means in motor vehicles, in particular for a vehicle occupant restraint system.

BACKGROUND OF THE INVENTION

Gas generators for vehicle occupant restraint systems usually include a solid propellant on the basis of sodium azide. In addition, gas generator propellants are known which consist of a combustible, mostly nitrogen-containing organic compound as well as suitable inorganic oxidizing agents. For igniting these gas generator propellants, mixtures on the basis of boron and potassium nitrate are typically used.

The EP-A2-0736511 describes an igniter composition for azide-free gas generator propellants, which contains 5 to 100 wt-% Mg, $TiH_2$, Al or Ti as fuels as well as 0 to 95 wt-% of a carbohydrate fuel with an oxygen content of 35 to 65 wt-%, and perchlorates or chlorates of sodium or potassium as oxidizing agents. The oxygen/fuel molar ratio of the igniter composition is at least 1, preferably at least 1.05.

The igniter compositions known from EP-A2-0736511 have a high combustion temperature, which during combustion leads to a very high content of gaseous components, for instance of potassium chloride, which gaseous components are hardly suited for priming the gas generator propellants. The known igniter compositions are also very sensitive to friction and can therefore not be brought to a manageable, precisely defined geometry or shape by jointly grinding them in a ball mill and subsequently compacting them on tabletting presses. Finally, the oxygen/fuel molar ratio of greater than 1, which is regarded as advantageous in the prior art, is not desirable, because at the high combustion temperatures a remarkable content of free oxygen is produced, which reacts with the nitrogen-containing gas generator propellants to form nitrogen oxides. WO-A-99/08983 describes an igniter composition on the basis of 5-aminotetrazole, strontium nitrate, aluminum, mica and boron nitride. Together with aluminum, the strontium nitrate used as oxidizer in this mixture only produces solid propellant residues. 5-Aminotetrazole preferably used as fuel is known to be very hygroscopic, whereby processing and storage of the known igniter compositions becomes difficult. As compared to the nitrates of guanidine compounds, such as nitroguanidine, the oxygen balance of 5-aminotetrazole is also much worse, i.e. a much higher content of oxidizer in the igniter composition is required. The igniter compositions used in WO-A-99/08983 furthermore have a positive oxygen balance which leads to the above described problems of nitrogen oxides being formed during combustion.

On the other hand, the conventionally used igniter compositions on the basis of boron and potassium nitrate mostly have a considerable oxygen underbalance, which results in large amounts of incompletely oxidized reaction products being released. These can attribute to an increase of the combustion temperature of the propellant as a result of a reaction of the incompletely oxidized reaction products of the igniter composition with constituents of the gas generator propellant.

Furthermore, $B/KNO_3$ igniter compositions are hygroscopic and exhibit an undesired aging behavior, which may be due to the formation of boric oxides. Finally, these igniter compositions are very expensive due to the high raw material price of boron. Moreover, the same is also true for the igniter compositions described in EP-A2-0763511.

Therefore, there is still a need for igniter compositions for gas generator propellants with suitable combinations of properties, such as a good storage stability, a low hygroscopicity, moderate combustion temperatures and good processing properties.

BRIEF SUMMARY OF THE INVENTION

To satisfy this need, the invention suggests an igniter composition for use in a gas generator for a safety means in motor vehicles, which igniter composition consists of a gas-generating composition in an amount of 15 to 70 wt-% and of a thermite composition in an amount of 30 to 85 wt-%. The gas-generating composition consists essentially of a guanidine compound as fuel and an inorganic oxidizer. The thermite composition consisting essentially of a metal and a metal oxide. The igniter composition or the gas-generating composition and the thermite composition, each for itself, have an oxygen balance of between 0 and −20%.

In accordance with the invention, oxygen balance is understood to be that amount of oxygen in percent by weight which is released upon complete reaction of the fuel to form $CO_2$, $H_2O$, $Al_2O_3$, $B_2O_3$ or other metal oxides (overbalancing of $O_2$). When the oxygen present is not enough, the shortage necessary for a complete reaction is indicated with a negative sign (underbalancing of $O_2$).

In the igniter composition in accordance with the invention, the guanidine compound is preferably selected from the group consisting of cyanoguanidine, guanidine nitrate, aminoguanidine nitrate, diaminoguanidine nitrate, triaminoguanidine nitrate, aminonitroguanidine and nitroguanidine as well as mixtures thereof. The inorganic oxidizer preferably is an alkali perchlorate or an alkali perchlorate in a mixture with ammonium perchlorate.

In the thermite composition, the metal is preferably selected from the group consisting of Al, Mg, Ti, Zr, Hf and Si or mixtures thereof. As metal oxide, there is preferably used an oxide of Si, Fe, Mn, V, Mo, Cu, Zn, Cr, Ti alone or in combination with each other.

Preferably, the thermite composition consists of Al and CuO.

The oxygen balances of the igniter composition or of the gas-generating composition and the thermite composition, respectively, vary between −2% and −15%, particularly preferably between −4% and −10%.

The igniter compositions according to the invention may also comprise up to 5 wt.-% usual processing aids such as trickling aids, pressing adjuvants and lubricants.

In the igniter compositions according to the invention, the gas-generating composition acts as atomizer and the thermite composition acts as supplier of particles. Together, they thus ensure a good priming of the gas generator propellant. In conventional known igniter compositions on the basis of $B/KNO_3$, excess boron competes with the fuel of the gas generator propellant and generates additional energy during combustion to form $B_2O_3$. Moreover, this can lead to the undesired formation of carbon monoxide in the gas mixture released. These effects cannot occur in the propellants according to the invention due to the more favorable oxygen balance.

In addition, the igniter compositions according to the invention are inexpensive to produce, exhibit a much lower hygroscopicity and a high aging resistance. Moreover, priming experiments in the gas generator have revealed that with a smaller amount of the igniter compositions according to the invention an improved or at least comparable priming is achieved as compared to mixtures on the basis of $B/KNO_3$.

Finally, it was found with the igniter compositions according to the invention that the non-gaseous reaction products advantageously are not only present as solid slag at the combustion temperature, but in a certain amount also in liquid form. The introduction of heat into the propellant to be primed is thereby improved. It is particularly preferred that at the combustion temperature of the mixture about one half of the non-gaseous reaction products of the igniter composition is present as solids and the other half is present in liquid form.

The invention will subsequently be described with reference to a few preferred embodiments. These examples should, however, merely illustrate the invention, but should not be understood in a limiting sense.

DETAILED DESCRIPTION OF THE PREFERRED EMBODIMENTS

EXAMPLE 1

39 parts by weight guanidine nitrate, 21 parts by weight potassium perchlorate, 30 parts by weight copper oxide and 10 parts by weight aluminum were ground, mixed with each other and compacted to form tablets. The mixture had a theoretical combustion temperature of 2,956 K; the oxygen balance was −4.8%. The storage test over 408 hrs at 107° C. showed a loss of weight of 0.08%. In the can test (2.5 $m^3$) there was determined a CO proportion of 240 ppm on activation of a standardized pyrotechnical gas generator. The $NO_X$ emission was 20 ppm.

In further experiments, the gas yield and the friction sensitivity as well as the hygroscopicity at various relative air humidity levels were determined. The results of these experiments are indicated in Tables 1 and 3.

EXAMPLE 2

31 parts by weight guanidine nitrate, 13 parts by weight potassium perchlorate, 41 parts by weight copper oxide and 15 parts by weight aluminum were ground, mixed with each other and compacted to form tablets. The igniter composition had a theoretical combustion temperature of 3,221 K; the oxygen balance was −7.2%. The storage test over 408 hrs at 107° C. showed a loss of weight of 0.09%.

In further experiments, the gas yield and the friction sensitivity of the igniter composition were determined. The results of these experiments are indicated in Table 1.

TABLE 1

| Example No. | Combustion temperature | Gas yield (mass-%) | Gas yield (mol/100 g) | Friction sensitivity | Oxygen balance |
|---|---|---|---|---|---|
| 1 | 2956K | 57 | 2.12 | >360 Nm | −4.8% |
| 2 | 3221K | 44 | 1.71 | >360 Nm | −7.2% |

Comparative Example 1

From 26 parts by weight boron and 74 parts by weight potassium nitrate a conventional igniter composition was prepared. The oxygen balance of this mixture amounted to −28.4%; the mixture had a combustion temperature of 3,078 K. The storage test over 408 hrs at 107° C. showed an increase in weight of 0.25%. In the can test (2.5 $m^3$) there was determined a CO proportion of 270 ppm on activation of the standardized pyrotechnical gas generator of example 1. The $NO_X$ emission was 20 ppm.

The experimentally obtained values for the gas yield, the friction sensitivity and the hygroscopicity at various relative air humidity levels are indicated in Tables 2 and 3.

Comparative Example 2

In accordance with the prescriptions of EP-A2-0736511 an igniter composition of 24.9 parts by weight $TiH_2$ and 75.1 parts by weight potassium perchlorate was prepared. The theoretical combustion temperature of this mixture was about 3,502 K; the oxygen balance was +10.7%. The experimentally obtained values for gas yield and friction sensitivity are indicated in Table 2.

Comparative Example 3

In accordance with the prescriptions of WO-A-99/08983 an igniter composition of 26 parts by weight 5-aminotetrazole, 64 parts by weight strontium nitrate, 7 parts by weight aluminum, 2 parts by weight mica and 1 part by weight boron nitride was prepared. The combustion temperature of this mixture was 3,105 K; the oxygen balance amounted to about −0.1%. The experimentally obtained results for the gas yield and the friction sensitivity as well as the hygroscopicity at various relative air humidity levels are indicated in Tables 2 and 3.

Comparative Example 4

In accordance with the prescriptions of WO-A-99/08983 an igniter composition of 28 parts by weight NTO, 62 parts by weight strontium nitrate, 8 parts by weight aluminum and 2 parts by weight mica was prepared. The combustion temperature of this igniter composition was 2,938 K; the oxygen balance was about +9.4%. The experimentally obtained values for gas yield and friction sensitivity are indicated in Table 2.

TABLE 2

| Comparative Example No. | Combustion temperature | Gas yield (mass-%) | Gas yield (mol/100 g) | Friction sensitivity | Oxygen balance |
|---|---|---|---|---|---|
| 1 | 3078 K. | 81 | 1.27 | >360 Nm | −28.4% |
| 2 | 3502K | 60 | 1.39 | 90 Nm | +10.7% |
| 3 | 3105K | 53.5 | 1.88 | 240 Nm | −0.1% |
| 4 | 2938K | 52.5 | 1.67 | 288 Nm | +9.4% |

TABLE 3

| | Increase in weight (%) after 168 hrs | | | |
|---|---|---|---|---|
| Composition | 45% rel. humidity of air | 55% rel. humidity of air | 65% rel. humidity of air | 86% rel. humidity of air |
| Comparative Example No. 1 | 0.11 | 0.13 | 0.24 | 0.63 |
| Comparative Example No. 3 | 2.06 | 3.58 | 5.48 | 7.70 |
| Comparative Example No. 1 | −0.07 | −0.03 | 0.02 | 0.18 |

The above results show that the igniter compositions according to the invention have improved or at least comparable properties as the igniter compositions known from the prior art. They also exhibit excellent priming properties and due to the advantageous oxygen balance do not tend to react with the constituents of the gas generator propellant and to form nitrogen oxides.

What is claimed is:

1. An igniter composition for use in a gas generator for a safety means in vehicles, said igniter composition consisting essentially of a gas-generating composition in an amount of 15 to 70 wt-% and of a thermite composition in an amount of 30 to 85 wt-%, said gas-generating composition consisting essentially of a guanidine compound as a fuel and an inorganic oxidizer, and said thermite composition consisting essentially of a metal and a metal oxide, said igniter composition or said gas-generating composition and said thermite composition, each for itself, having an oxygen balance of between 0 and −20%.

2. The igniter composition as claimed in claim 1, wherein said guanidine compound is selected from the group consisting of cyanoguanidine, guanidine nitrate, aminoguanidine nitrate, diaminoguanidine nitrate, triaminoguanidine nitrate, aminonitroguanidine and nitroguanidine as well as mixtures thereof.

3. The igniter composition as claimed in claim 1, wherein said inorganic oxidizer is one of alkali perchlorate and alkali perchlorate in a mixture with ammonium perchlorate.

4. The igniter composition as claimed in claim 1, wherein said metal is at least one of the following elements: Al, Mg, Ti, Zr, Hf and Si.

5. The igniter composition as claimed in claim 1, wherein said metal oxide is at least one oxide selected from the group of oxides with the following elements: Si, Fe, Mn, V, Mo, Cu, Zn, Cr, Ti.

6. The igniter composition as claimed in claim 1, wherein said thermite composition consists of Al and CuO.

7. The igniter composition as claimed in claim 1, wherein the oxygen balance varies between −2% and −15%.

8. The igniter composition as claimed in claim 7, wherein the oxygen balance varies between −4% and −10%.

* * * * *